US007688949B2

(12) United States Patent
Warburton et al.

(10) Patent No.: US 7,688,949 B2
(45) Date of Patent: Mar. 30, 2010

(54) X-RAY TUBE COOLING SYSTEM

(75) Inventors: Don Lee Warburton, West Jordan, UT (US); Jason W. Davies, Cottonwood Heights, UT (US); Gregory C. Andrews, Draper, UT (US); Mark S. Jonaitis, Sandy, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 12/028,698

(22) Filed: Feb. 8, 2008

(65) Prior Publication Data

US 2009/0086917 A1 Apr. 2, 2009

Related U.S. Application Data

(63) Continuation-in-part of application No. 11/864,603, filed on Sep. 28, 2007, now Pat. No. 7,616,736.

(51) Int. Cl.
*H01J 35/18* (2006.01)

(52) U.S. Cl. ..... 378/140; 378/141; 378/200

(58) Field of Classification Search ..... 378/140, 378/141, 199, 200

See application file for complete search history.

(56) References Cited

U.S. PATENT DOCUMENTS

| | | | |
|---|---|---|---|
| 5,511,104 | A | 4/1996 | Mueller et al. |
| 6,005,918 | A | 12/1999 | Harris et al. |
| 6,215,852 | B1 | 4/2001 | Rogers et al. |
| 6,263,046 | B1 | 7/2001 | Rogers |
| 6,438,208 | B1 | 8/2002 | Koller |
| 6,457,859 | B1 | 10/2002 | Lu et al. |
| 6,529,579 | B1 | 3/2003 | Richardson |
| 6,594,341 | B1 | 7/2003 | Lu et al. |
| 6,714,626 | B1 | 3/2004 | Subraya et al. |
| 7,042,981 | B2 | 5/2006 | Subraya et al. |
| 7,260,181 | B2 | 8/2007 | McDonald et al. |

*Primary Examiner*—Jurie Yun
(74) *Attorney, Agent, or Firm*—Workman Nydegger

(57) ABSTRACT

X-ray tube cooling systems. In one example embodiment, an x-ray tube includes a housing, a window frame attached to the housing, and a window attached to the window frame. The housing defines an aperture through which electrons can pass from a cathode to an anode. The housing also defines an inlet port and an outlet port. The window frame defines an opening through which x-rays can pass. The window covers the opening defined by the window frame. The housing and the window frame are configured such that a liquid can flow from the inlet port to the outlet port through either a first liquid path at least partially defined by the housing or a second liquid path cooperatively defined by the housing and the window frame. The second liquid path is disposed about at least a portion of the opening in the window frame.

26 Claims, 9 Drawing Sheets

X-RAY TUBE COOLING SYSTEM

CROSS-REFERENCE TO A RELATED APPLICATION

This application is a continuation-in-part of U.S. patent application Ser. No. 11/864,603, filed on Sep. 28, 2007, which is incorporated herein by reference in its entirety.

BACKGROUND

X-ray tubes typically utilize an x-ray transmissive window formed in the vacuum enclosure of the x-ray tube that permits x-rays produced within the x-ray tube to be emitted from the housing and into an intended target. The window is typically set within a mounting structure, and is located in a side or in an end of the x-ray tube. The window separates the vacuum of the vacuum enclosure of the x-ray tube from the normal atmospheric pressure found outside the x-ray tube or from the pressure of a liquid coolant in which the x-ray tube is submerged.

Although window thicknesses vary depending on the particular x-ray tube application, windows are typically very thin. In particular, a window with a reduced thickness is generally desired so as to minimize the amount of x-rays that are absorbed by the window material during x-ray tube operation.

While a thinner window is desirable, a thin window is typically subjected to deforming stresses during the operation of the x-ray tube. One of the major challenges in developing x-ray tubes for modern, high performance x-ray systems is to provide design features to accommodate the high levels of heat produced. To produce x-rays, relatively large amounts of electrical energy must be transferred to an x-ray tube. Only a small fraction of the electrical energy transferred to the x-ray tube is converted into x-rays, as the majority of the electrical energy is converted to heat. If excessive heat is produced in the x-ray tube, the temperature can rise above critical values, and the window of the x-ray tube can be subject to thermally-induced deforming stresses. Such thermally-induced deforming stresses are non-uniformly distributed over the surface of the window and can produce cracking in the window, as well as leaks between the window and the mounting structure.

One portion of the window which is frequently deformed during x-ray tube operation due to relatively high heat is the portion of the window that is bonded to the mounting structure. The deformation of the window can result in cracking of the window and consequent loss of vacuum from the x-ray tube housing, and thereby limit the operational life of the x-ray tube.

In addition to increasing the likelihood of a cracked window, the heat produced during x-ray tube operation can also result in the boiling of liquid coolant in which the x-ray tube is submerged and that is in direct contact with the window. This boiling of the liquid coolant can result in detrimental attenuations in the x-rays as they pass through the boiling liquid on their way to the intended target. This detrimental attenuation of the x-rays can cause defects in the resulting x-ray images of the target, which can result, for example, in a misdiagnosis of a patent being x-rayed.

BRIEF SUMMARY OF EXAMPLE EMBODIMENTS

In general, example embodiments of the invention relate to systems and methods for cooling an x-ray tube. The examples disclosed herein can help dissipate heat generated during x-ray tube operation and thus have a cooling effect on, and thereby reduce thermally-induced deforming stresses on, various components of the x-ray tube. Other advantages can also be realized. For example, disclosed embodiments can help reduce boiling of liquid coolant in which the x-ray tube is disposed and that is in direct contact with components of the x-ray tube, thereby decreasing attenuation of x-rays passing through the liquid coolant.

In one example embodiment, an x-ray tube includes a housing, a window frame attached to the housing, and a window attached to the window frame. The housing includes an aperture through which electrons can pass from a cathode to an anode. The housing also includes an inlet port and an outlet port. The window frame defines an opening through which x-rays can pass. The window covers the opening defined by the window frame. The housing and the window frame are configured such that a liquid coolant can flow from the inlet port to the outlet port through either a first liquid path at least partially defined by the housing or a second liquid path cooperatively defined by the housing and the window frame. The second liquid path is disposed about at least a portion of the opening in the window frame.

In another example embodiment, an x-ray tube includes a housing, a window frame attached to the housing, and a window attached to the window frame. The housing includes an inlet port and an outlet port. The window frame defines an opening through which x-rays can pass. The window covers the opening defined by the window frame. The x-ray tube also includes first, third, and fourth liquid passageways at least partially defined by the housing, and a second liquid passageway cooperatively defined by the housing and the window frame. The second liquid passageway is disposed about at least a portion of the opening in the window frame. A first portion of a liquid coolant can flow from the inlet port to the outlet port through a first liquid path, defined by the first, second, and fourth liquid passageways, without flowing through the third liquid passageway. A second portion of the liquid coolant can flow from the inlet port to the outlet port through a second liquid path, defined by the first, third, and fourth liquid passageways, without flowing through the second liquid passageway.

In yet another example embodiment, an x-ray tube includes a can, a liquid manifold attached to the can, a shield structure attached to the can, a window frame attached to the can, and a window attached to the window frame. The liquid manifold defines an inlet port and an outlet port. The shield structure defines an aperture that allows electrons to pass from an electron source to a target anode. The window frame defines an opening through which x-rays can pass. The window covers the opening defined by the window frame. The x-ray tube also includes first, second, third, and fourth liquid passageways. The first liquid passageway is cooperatively defined by the liquid manifold, the can, and the shield structure. The second liquid passageway is cooperatively defined by the can and the window frame and is disposed about at least a portion of the opening in the window frame. The third liquid passageway is cooperatively defined by the can and the shield structure. The fourth liquid passageway is cooperatively defined by the can, the shield structure, and the liquid manifold. A first portion of a liquid coolant can flow from the inlet port to the outlet port through a first liquid path, defined by the first, second, and fourth liquid passageways, without flowing through the third liquid passageway. A second portion of the liquid coolant can flow from the inlet port to the outlet port through a second liquid path, defined by the first, third, and fourth liquid passageways, without flowing through the second liquid passageway.

These and other aspects of example embodiments of the invention will become more fully apparent from the following description and appended claims.

BRIEF DESCRIPTION OF THE DRAWINGS

To further clarify the above and other aspects of example embodiments of the present invention, a more particular description of these examples will be rendered by reference to specific embodiments thereof which are disclosed in the appended drawings. It is appreciated that these drawings depict only example embodiments of the invention and are therefore not to be considered limiting of its scope. It is also appreciated that the drawings are diagrammatic and schematic representations of example embodiments of the invention, and are not limiting of the present invention nor are they necessarily drawn to scale. Example embodiments of the invention will be disclosed and explained with additional specificity and detail through the use of the accompanying drawings in which.

DETAILED DESCRIPTION OF EXAMPLE EMBODIMENTS

In general, example embodiments of the invention are directed to x-ray tube cooling systems. The example x-ray tube cooling systems disclosed herein can be employed to dissipate heat generated during x-ray tube operation and thus reduce thermally-induced deforming stresses on the cooled components of the x-ray tube and reduce boiling of liquid coolant in which the x-ray tube is submerged and that is in direct contact with cooled components of the x-ray tube, thereby decreasing attenuation of x-rays passing through the liquid coolant.

I. Example X-Ray Tube Cooling System

Figure 1:
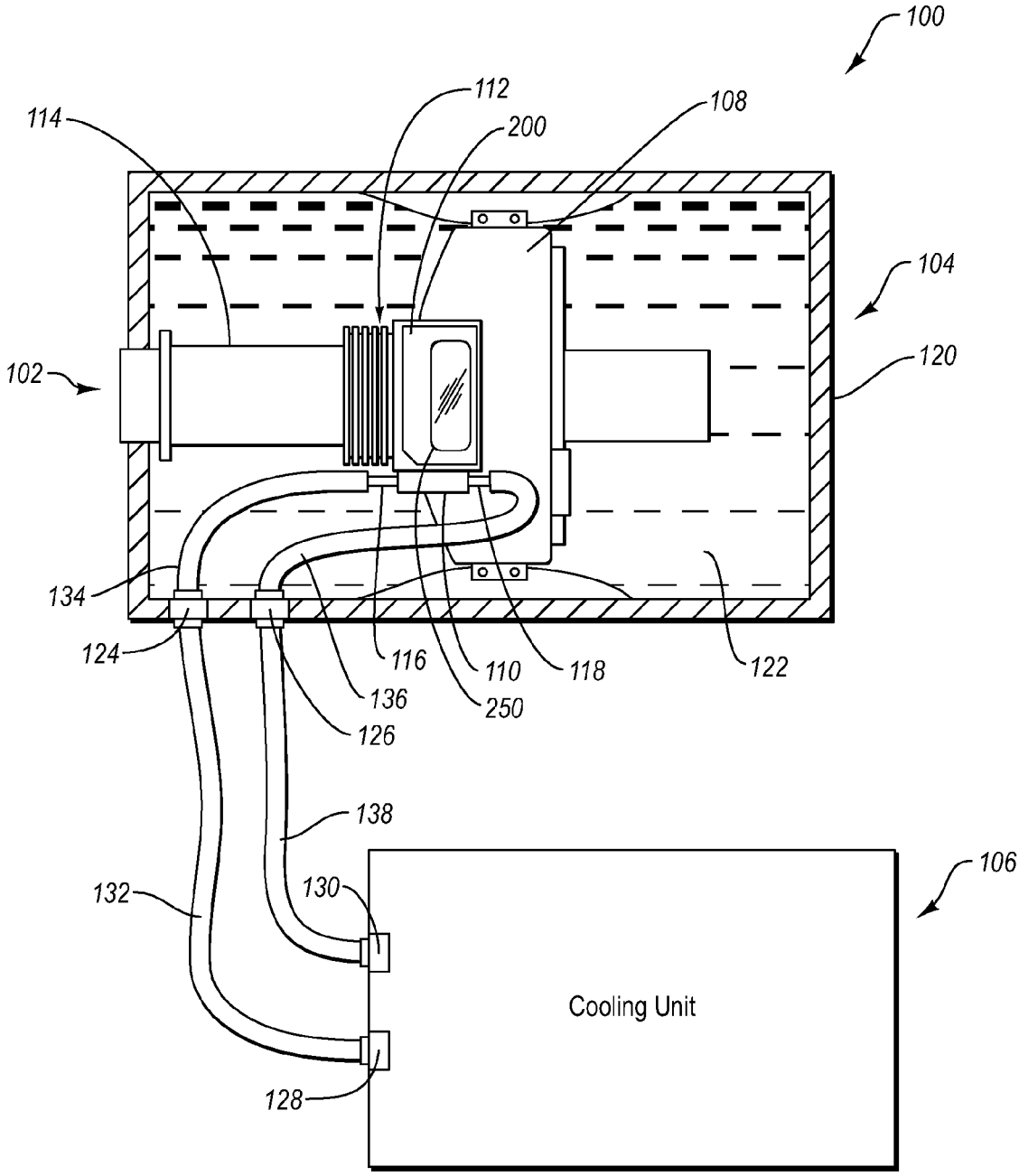
FIG. 1 is a plan view of an example x-ray tube cooling system including an example x-ray tube, an example reservoir, and an example cooling unit.

With reference first to FIG. 1, an example x-ray tube cooling system 100 is disclosed. The example x-ray tube cooling system 100 generally includes an example x-ray tube 102, an example reservoir 104, and an example cooling unit 106.

The example x-ray tube 102 generally includes a housing made up of a can 108, a liquid manifold 110 attached to the can 108, a shield structure 112 attached to the can 108, and a cathode cylinder 114 attached to the can 108. The liquid manifold 110 includes an inlet port 116 and an outlet port 118. The shield structure 112 is substantially similar in form and function to the shield structure 108 disclosed in U.S. Pat. No. 6,519,318, titled "Large Surface Area X-Ray Tube Shield Structure," the disclosure of which is incorporated herein by reference in its entirety. The example x-ray tube 102 also includes a window frame 200 attached to the can 108 and a window 250 attached to the window frame 200.

The example reservoir 104 includes a sidewall 120 which substantially encloses the example x-ray tube 102 such that the example x-ray tube 102 is positioned substantially within the reservoir 104. The sidewall 120 also cooperates with the cathode cylinder 114 of the x-ray tube 102 to hold a liquid coolant 122 which substantially surrounds the x-ray tube 102. The liquid coolant 122 can be circulated into and out of the reservoir 104 (not shown) in order to dissipate heat generated during the operation of the x-ray tube 102. In one example embodiment, the liquid coolant 122 can be a dielectric liquid coolant. Examples of dielectric liquids include, but are not limited to: fluorocarbon or silicon based oils, or de-ionized water. Further, the sidewall 120 defines an inlet port 124 and an outlet port 126, aspects of which will be discussed below in connection with the example cooling unit 106.

The example cooling unit 106 includes an outlet port 128 and an inlet port 130. The cooling unit 106 is configured to cool liquid coolant (not shown—separate from the liquid coolant 122) received at the inlet port 130 and then circulate the cooled liquid coolant through the outlet port 128.

The operation of the example x-ray tube cooling system 100 will now be disclosed in connection with FIG. 1. Although the example x-ray tube 102 is positioned substantially internal to the example reservoir 104 and the example cooling unit 106 is positioned external to the reservoir 104, the x-ray tube 102, the reservoir 104, and the cooling unit 106 are all interconnected via a set of hoses 132-138. In particular, the outlet port 128 of the cooling unit 106 is connected via the hose 132 to the inlet port 124 of the example reservoir 104, the inlet port 124 is connected via the hose 134 to the inlet port 116 of the example x-ray tube 102, the outlet port 118 of the x-ray tube 102 is connected via the hose 136 to the outlet port 126 of the reservoir 104, and the outlet port 126 is connected via the hose 138 to the inlet port 130 of the cooling unit 106.

In another example embodiment, the hose 134, possibly in combination with other hoses (not shown) may enable a liquid coolant to circulate through another portion of the x-ray tube 102 after the liquid coolant passes through the inlet port 124 but before the liquid coolant enters the inlet port 116. Similarly, the hose 136, possibly in combination with other hoses (not shown), may enable the liquid coolant to circulate through yet another portion of the x-ray tube 102 after the liquid coolant exits the outlet port 118 but before the liquid coolant pass through the outlet port 126. For example, the outlet port 118 of the x-ray tube 102 may be connected to a second inlet port 117 (see FIG. 2A) via another hose (not shown) in order to allow the liquid coolant to circulate through another portion of the x-ray tube 102 and exit the x-ray tube through a second outlet port 119 (see FIG. 2B). The hose 136 can, in this example, be connected between the second outlet port 119 and the outlet port 126 to allow the liquid coolant to circulate back to the cooling unit 106.

The hoses 132-138 thus enable a liquid coolant to be circulated between the cooling unit 106 and the x-ray tube 102 without mixing with the liquid coolant 122 held by the reservoir 104. Thus, the liquid coolant circulating through the hoses 132-138 and the liquid coolant 122 in the reservoir 104 may be different types of liquid coolant. For example, the liquid coolant circulating through the hoses 132-138 can be a non-dielectric liquid coolant and the coolant 122 can be a dielectric coolant. In this example embodiment, a non-dielectric liquid may be employed because the non-dielectric liquid coolant is electrically insulated from electrically sensitive portions of the x-ray tube 102. In another example, both the liquid coolant circulating through the hoses 132-138 and the coolant 122 can be dielectric coolants, but may be different types of dielectric coolants. Examples of non-dielectric liquids include, but are not limited to: water, propylene glycol, or some combination thereof. Examples of dielectric liquids include, but are not limited to: fluorocarbon or silicon based oils, or de-ionized water. In one example embodiment, the hoses 132-138 may be rubber hoses capable of maintaining a hose pressure of about 30 psi, although hoses of other materials that are capable of maintaining other hose pressures can be employed. For example, the hoses 132 and 134 may be capable of maintaining a hose pressure of about 22.5 psi and the hoses 136 and 138 may be capable of maintaining a hose pressure of about 16.5 psi. In one example embodiment, the hoses 132-138 may be attached to the corresponding ports using a hose clamp, although any other suitable device or method for attachment can be employed.

In operation, a liquid coolant having a relatively low temperature can flow from the cooling unit 106 through the hoses 132 and 134 to the x-ray tube 102. The liquid coolant is then circulated through the x-ray tube 102 where the temperature of the liquid coolant is raised as heat generated by the x-ray tube is transferred to the liquid coolant. The liquid coolant having a relatively high temperature can then flow back to the cooling unit 106 through the hoses 136 and 138 where the temperature of the liquid coolant is once lowered in preparation for re-circulation through the system 100. Positioning the cooling unit 106 external to the reservoir 104 enables relatively cool liquid coolant to be circulated into the x-ray tube 102 and relatively warm liquid coolant to be circulated out of the x-ray tube 102 without the need for a cooling unit internal to the reservoir 104. Including a cooling unit internal to the reservoir 104, either attached to the x-ray tube 102 or the reservoir 104 can add cost and complexity to the system 100.

II. Example X-ray Tube

Figure 2A:
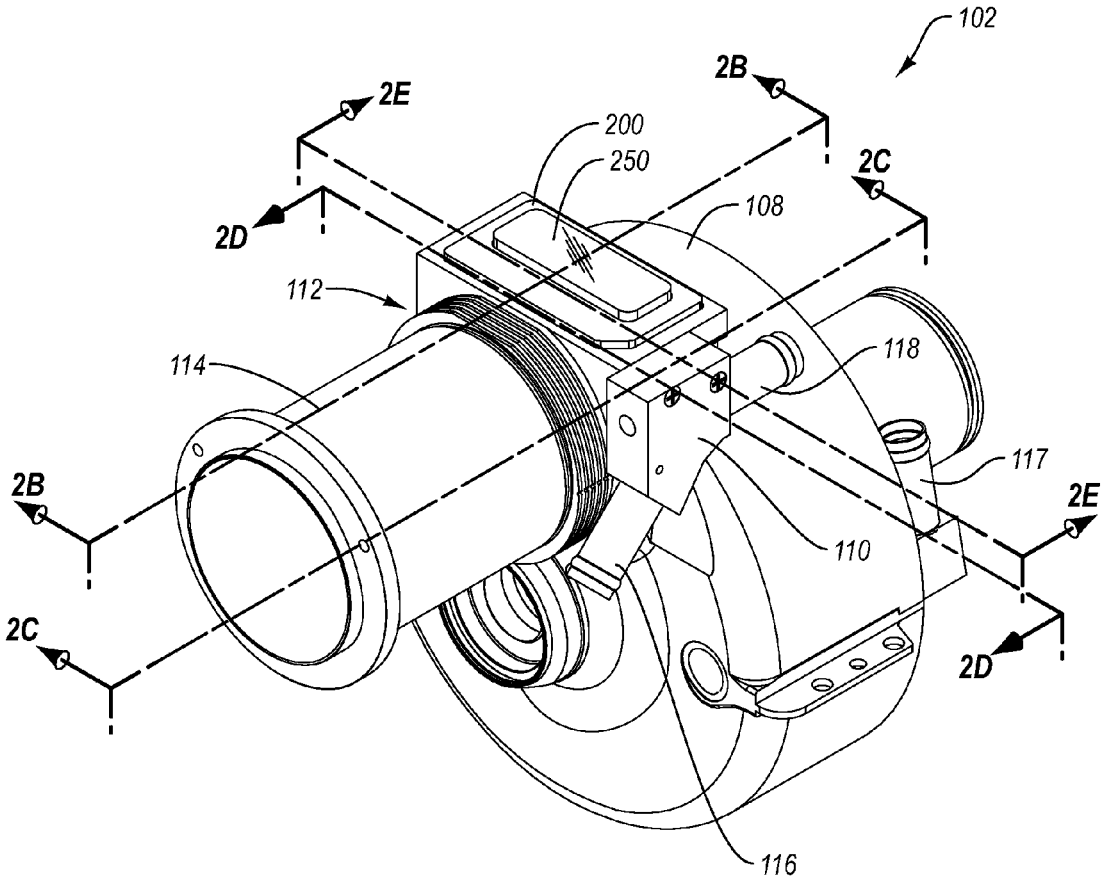
FIG. 2A is a perspective view of the example x-ray tube of FIG. 1 having an example window frame and an example window.
Figure 2B:
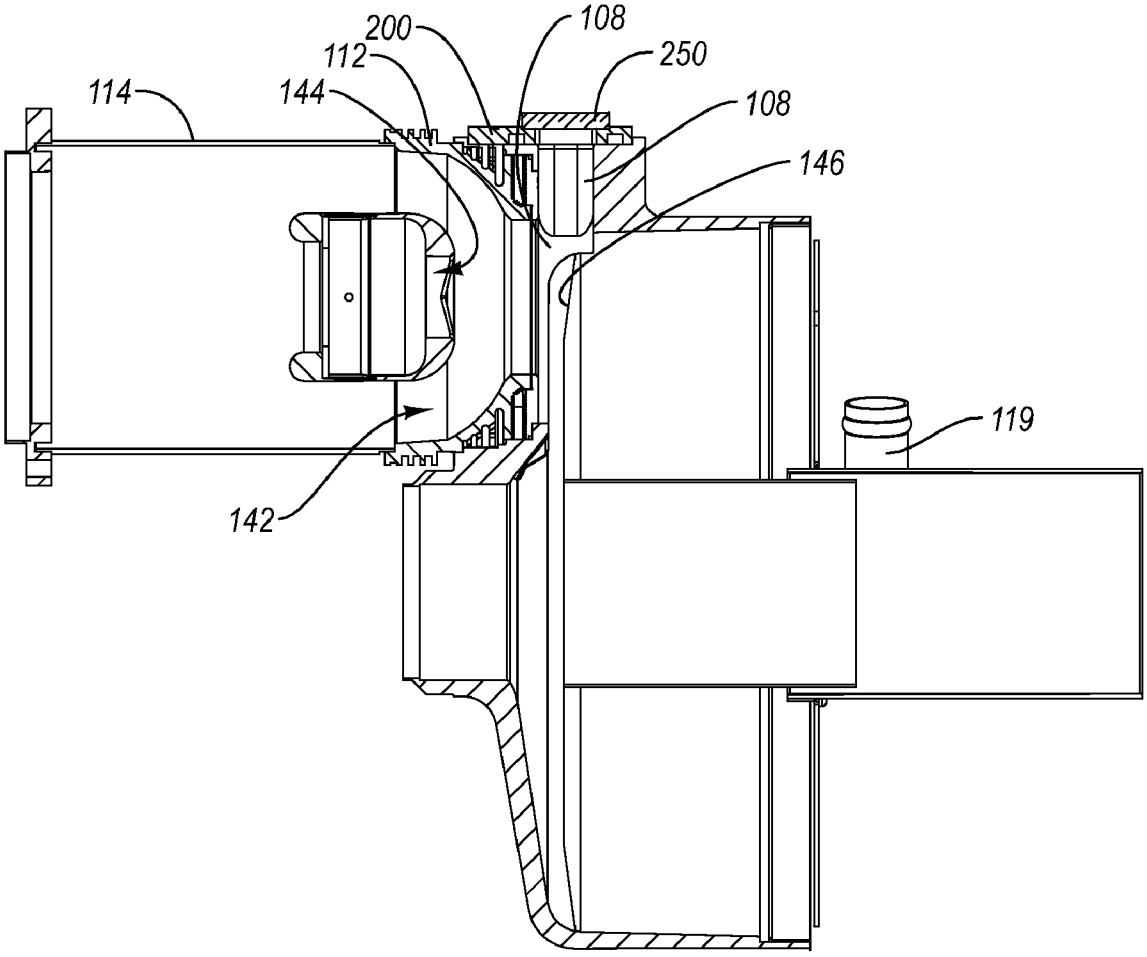
FIG. 2B is a partial cross-sectional side view of the example x-ray tube of FIG. 2A.
Figure 2C:
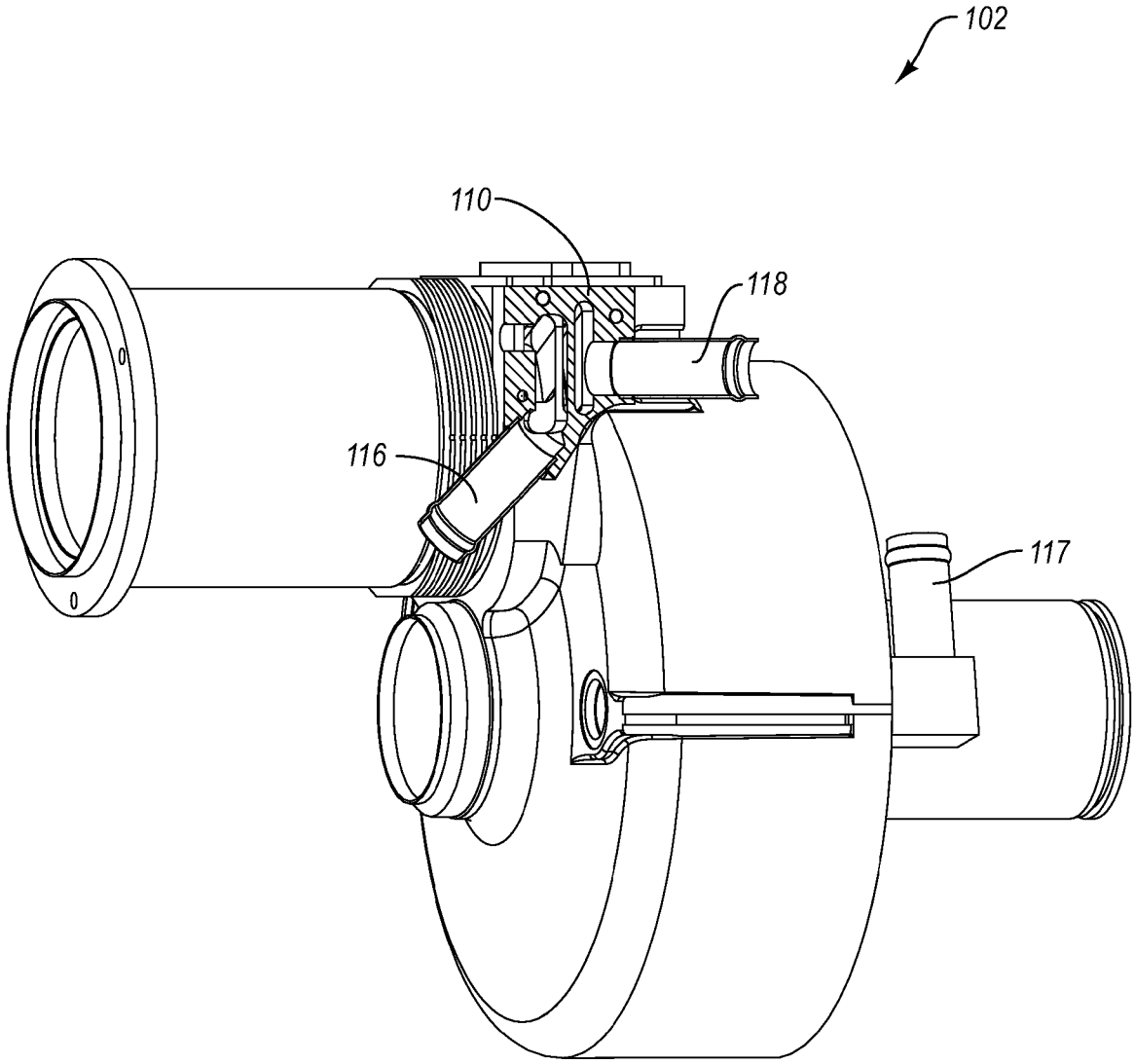
FIG. 2C is a partial cross-sectional perspective view of the example x-ray tube of FIG. 2A.

With reference now to FIGS. 2A and 2B together, additional aspects of the example x-ray tube 102 are disclosed. The can 108, the shield structure 112, the cathode cylinder 114, the window frame 200, and the window 250 cooperate to define at least a portion of a vacuum enclosure 142 that encloses a cathode 144 and the rotating anode 146. Prior to operation of the x-ray tube 102, the vacuum enclosure 142 is evacuated to create a vacuum. During the operation of the x-ray tube 102, electrons emitted from the cathode 144 strike the rotating anode 146. Upon striking the rotating anode 146, a portion of the electrons are converted into x-rays that are directed toward the window 250. As the window 250 is made from an x-ray transmissive material, these x-rays can then escape the vacuum enclosure 142 through the window 250 and strike an intended target (not shown) to produce an x-ray image (not shown). The window 250 therefore seals the vacuum of vacuum enclosure 142 of the x-ray tube 102 from the pressure from the liquid coolant 122 (see FIG. 1) in which the x-ray tube 102 is submerged, and yet enables x-rays generated by the rotating anode 146 to exit the x-ray tube 102, pass through the coolant 122, and exit the reservoir 104 through a corresponding window (not shown) in the sidewall 120.

Although the example x-ray tube 102 is depicted as a rotary anode x-ray tube, example embodiments of the x-ray tube cooling systems disclosed herein can be employed in any type of x-ray tube that utilizes an x-ray transmissive window. Thus, the example x-ray tube cooling systems disclosed herein can alternatively be employed, for example, in a stationary anode x-ray tube.

Figure 2D:
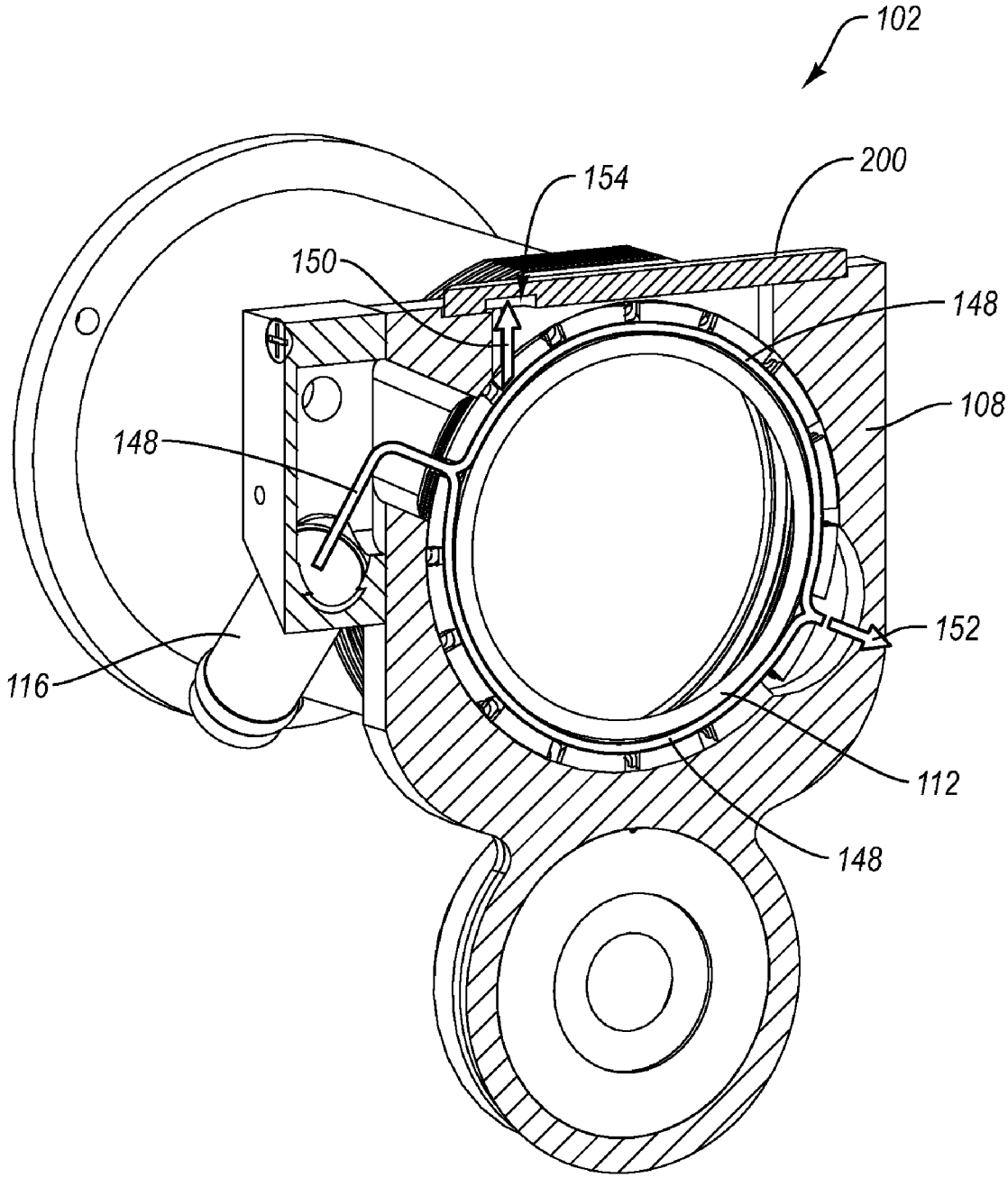
FIG. 2D is another cross-sectional perspective view of the example x-ray tube of FIG. 2A.
Figure 2E:
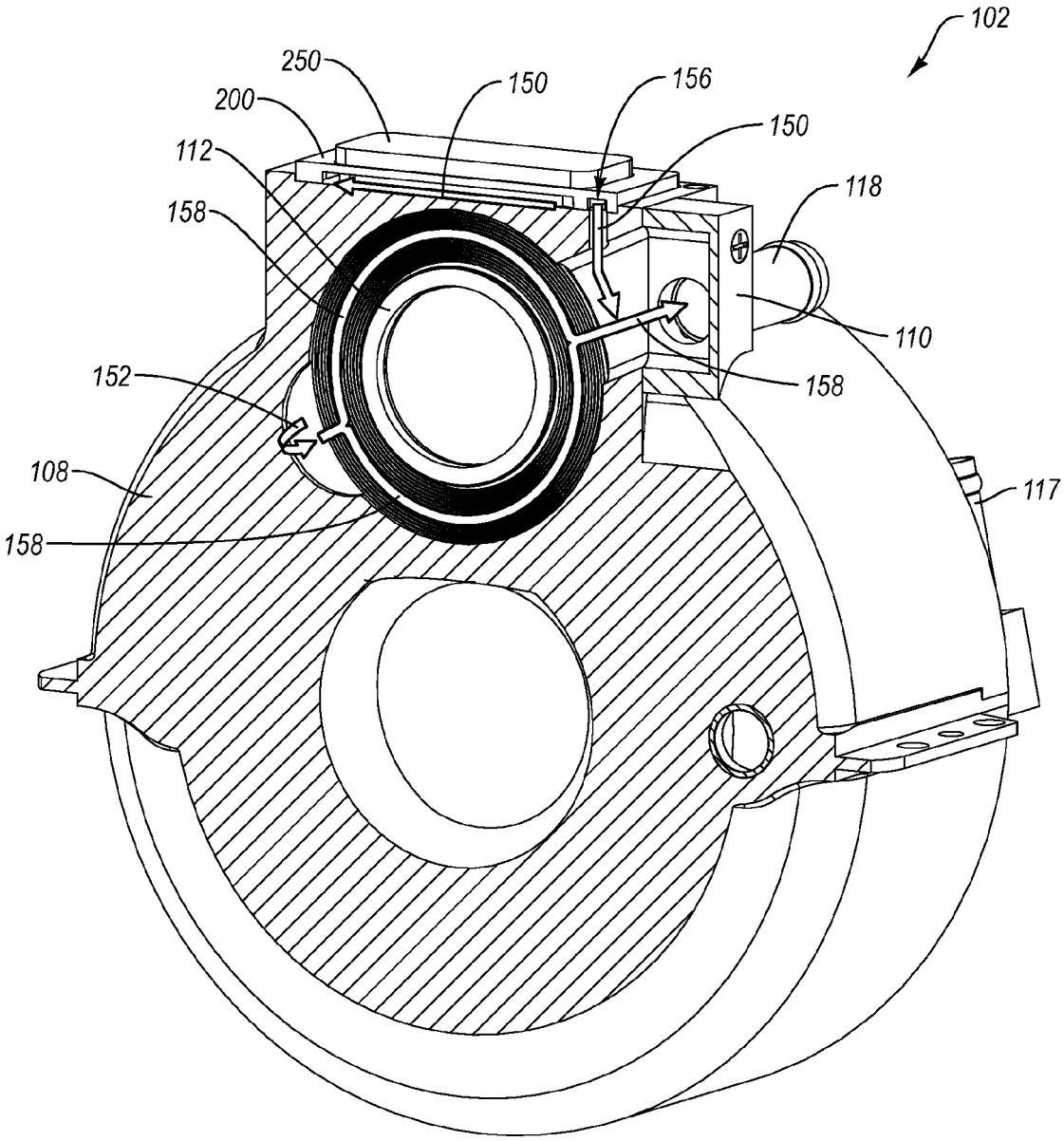
FIG. 2E is yet another cross-sectional perspective view of the example x-ray tube of FIG. 2A.
Figure 2F:
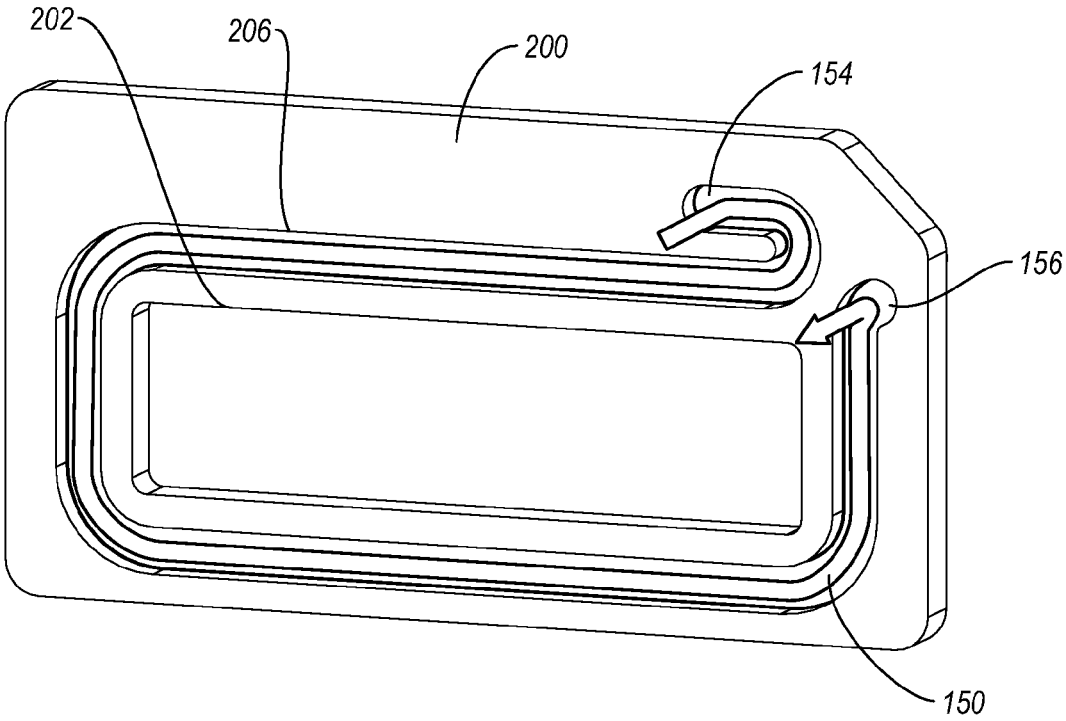
FIG. 2F is a bottom perspective view of an example window frame of the example x-ray tube of FIG. 2A.

With reference now to FIGS. 2C-2G, additional aspects concerning the operation of the example x-ray tube 102 will be disclosed. As disclosed in FIGS. 2C and 2D, during the operation of the x-ray tube 102, when a liquid coolant (not shown) is received through the inlet port 116 of liquid manifold 110, the liquid coolant first flows into a first liquid passageway 148 cooperatively defined by the liquid manifold 110, the can 108, and the shield structure 112. The first liquid passageway 148 generally extends radially around the shield structure 112. With reference now to FIGS. 2D-2F, from the first liquid passageway 148 the liquid coolant can either flow into a second liquid passageway 150 cooperatively defined by the can 108 and the window frame 200 or into a third liquid passageway 152 cooperatively defined by the can 108 and the shield structure 112.

As disclosed in FIG. 2F, the window frame 200 defines an opening 202 through which x-rays can pass. As disclosed in FIGS. 2D-2F, the second liquid passageway 150 is disposed about at least a portion of the opening 202 in the window frame 200. In particular, the second liquid passageway 150 includes an inlet 154 and an outlet 156. As disclosed in FIG. 2E, the liquid coolant can flow through either the second liquid passageway 150 or the third liquid passageway 152 into a fourth liquid passageway 158 cooperatively defined by the can 108, the shield structure 112, and the liquid manifold 110. The liquid coolant can then exit the x-ray tube 102 through the outlet port 118.

Figure 2G:
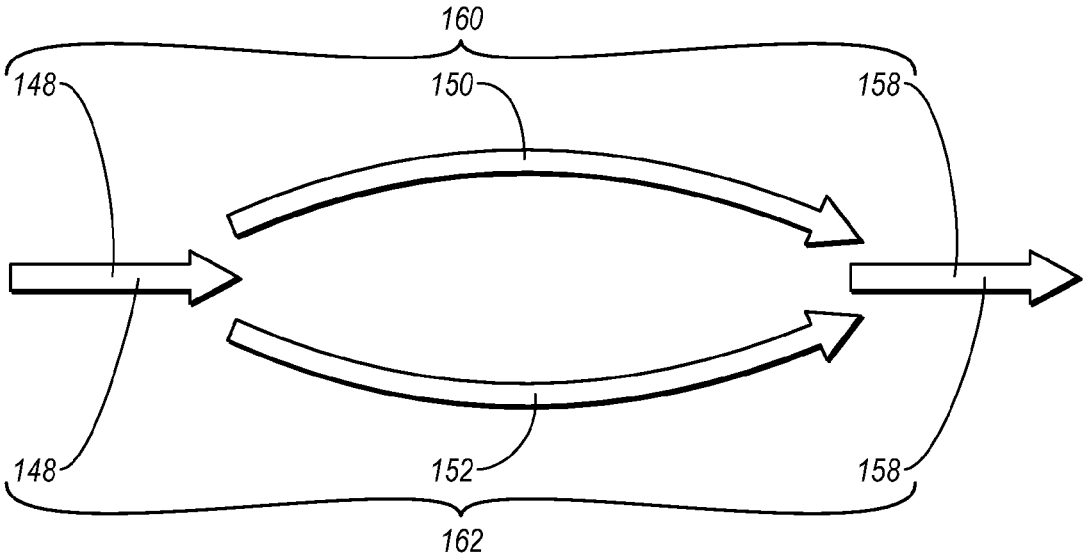
FIG. 2G is a flowchart of two example liquid paths through which liquid coolant can flow in the example x-ray tube of FIG. 2A.

As disclosed in FIG. 2G, the liquid coolant can flow from the inlet port 116 to the outlet port 118 through one of two liquid paths. The first liquid path 160 is defined by the first liquid passageway 148, the second liquid passageway 150, and the fourth liquid passageway 158. The second liquid path 162 is defined by the first liquid passageway 148, the third liquid passageway 152, and the fourth liquid passageway 158. A portion of the liquid coolant flowing between the inlet port 116 and the outlet port 118 can therefore flow through the first liquid path 160 without flowing through the third liquid passageway 152. Another portion of the liquid coolant flowing between the inlet port 116 and the outlet port 118 can therefore flow through the second liquid path 162 without flowing through the second liquid passageway 150.

In some example embodiments, the first liquid path 160 and the second liquid path 162 are sized and configured such that a pressure gradient exists when the liquid coolant is flowing from the inlet port 116 to the outlet port 118. For example, the pressure gradient between the inlet port 116 and the outlet port 118 can be about 6 psi, although other pressure gradients greater than 0 psi can be employed depending on performance requirements of the x-ray tube 102.

Further, in some example embodiments, the first liquid path 160 and the second liquid path 162 can be sized and configured such that a relatively high volume/minute of the liquid coolant can flow between the inlet port 116 and the outlet port 118. For example, about 4.2 gallons/minute of the liquid coolant can flow between the inlet port 116 and the outlet port 118, although other rates of liquid coolant flow can be employed depending on performance requirements of the x-ray tube 102.

Moreover, in some example embodiments, the first liquid path 160 and the second liquid path 162 are sized and configured such that, when the liquid coolant is flowing between the inlet port 116 and the outlet port 118, between about 90% and about 98% of the liquid coolant flows through the first liquid path 160 and between about 2% and about 10% of the liquid coolant flows through the second liquid path 162. For example, between about 93% and about 98% of the liquid can flow through the first liquid path 160 and between about 2% and about 7% of the liquid coolant can flow through the second liquid path 162. In another example, between about 94% and about 97% of the liquid coolant can flow through the first liquid path 160 and between about 3% and about 6% of the liquid coolant can flow through the second liquid path 162. In yet another example, about 95.5% of the liquid coolant can flow through the first liquid path 160 and about 4.5% of the liquid coolant can flow through the second liquid path 162. The relative percentages of liquid coolant that will flow through the first liquid path 160 or the second liquid path 162 can be adjusted during the design of the x-ray tube 102 depending on the respective heat dissipation needs of the shield structure 112 on the one hand, and the window frame 200 and the window 250 on the other. For example, where the opening 202 in the window frame 200 is relatively larger, the heat dissipation needs of the window 250 may be greater than where the opening 202 is relatively smaller.

In some example embodiments, the inlet 154 and the outlet 156 of the second liquid passageway 150 can alternatively be positioned proximate each other in a single liquid passageway. For example, the window frame 200 can be configured such that the inlet 154 and the outlet 156 are both positioned near the outlet port 118 in the fourth liquid passageway 158. In this example, at least a portion of the liquid coolant entering through the inlet port 116 can flow through all of the first, second, third, and fourth liquid passageways before exiting through the outlet port 118.

II. Example Window Frame and Window

With reference now to FIGS. 3A-3F, additional aspects of the example window frame 200 and the example window 250 are disclosed. As disclosed in FIG. 3A, the perimeter of the window frame 200 is generally rectangularly shaped, although the perimeter could alternatively be various other shapes. In one example embodiment, the example window frame 200 is about 0.205 inches thick, although the example window frame 200 may alternatively be greater than or less than about 0.205 inches thick. The window frame may be formed from various materials including, but not limited to, copper or a copper alloy.

Figure 3C:
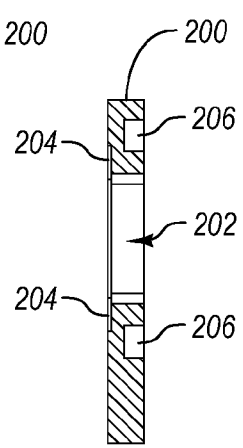
FIG. 3C is a cross-sectional side view of the example window frame of FIG. 3B.
Figure 3B:
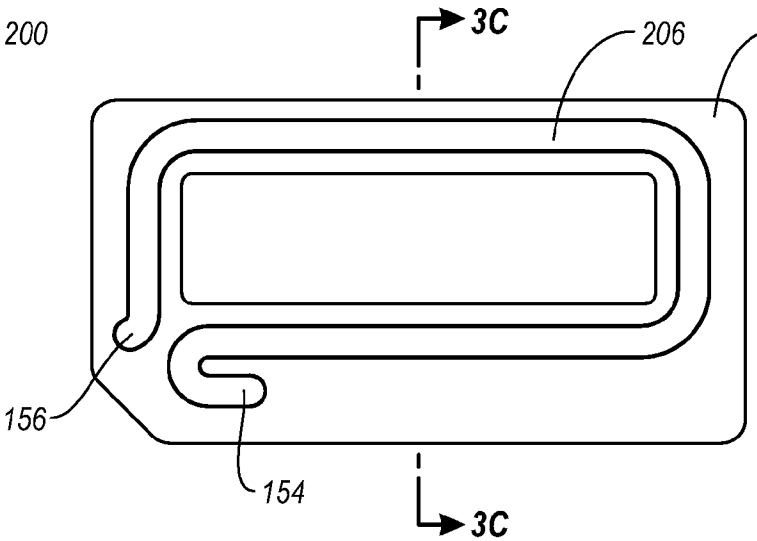
FIG. 3B is a bottom view of the example window frame of FIG. 2F.
Figure 3A:
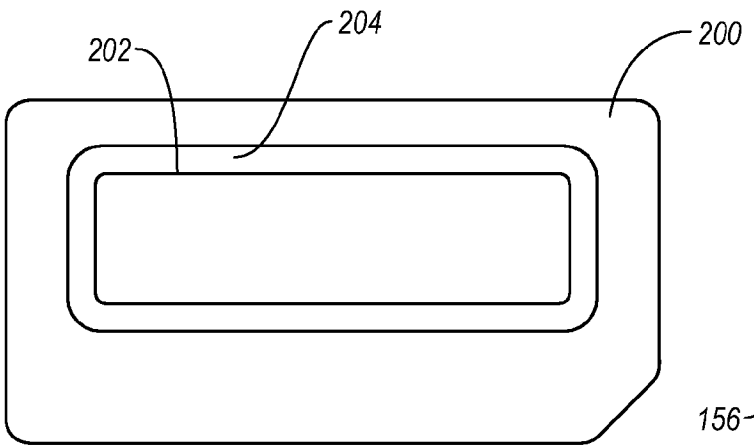
FIG. 3A is a top view of the example window frame of FIG. 2F.

As disclosed in FIG. 3A, the example window frame 200 defines an opening 202. The opening 202 is generally sized and configured to allow x-rays to pass therethrough. The perimeter of the opening 202 is generally rectangularly shaped, although the perimeter could alternatively be various other shapes. In one example embodiment, the opening 202 is about 2.700 inches long and about 0.740 inches wide, although the example opening 202 may alternatively be greater than or less than about 2.700 inches long and/or about 0.740 inches wide. The example window frame 200 may also include a recessed portion 204 to which the example window 250 can be bonded (see FIG. 3E), as discussed below.

As disclosed in FIGS. 3B and 3C, the window frame 200 further defines an example liquid channel 206. The example liquid channel 206 is generally disposed about a portion of the opening 202, although the liquid channel 206 could alternatively be disposed about a greater or lesser portion of the opening 202 than is disclosed in FIG. 3B. For example, the liquid channel 206 could alternatively be disposed all the way around opening 202 so as to completely surround the opening 202. In one example embodiment, the liquid channel 206 is about 0.182 inches wide, although the example liquid channel 206 may alternatively be greater than or less than about 0.182 inches wide. Further, as disclosed elsewhere herein, the geometry, position, size, and orientation of the liquid channel 206 may vary from the configuration disclosed in FIGS. 3B and 3C. The liquid channel 206 may further be accompanied by one or more additional liquid channels, as disclosed elsewhere herein.

As disclosed elsewhere herein, the second liquid passageway 150 includes the inlet 154 and the outlet 156, as well as additional inlets and/or outlets. Further, the sizes, locations, and orientations of the inlet 154 and/or the outlet 156 may vary from those disclosed in FIG. 3B. For example, the inlet 154 and/or the outlet 156 may extend to the edges of the window frame 200, instead of being defined by the window frame 200. The inlet 154 and/or the outlet 156 may further include additional structure(s) (not shown) that enables the inlet 154 and/or the outlet 156 to be coupled to elements of the example x-ray tube cooling system 100 disclosed herein, such as liquid passageways (see FIGS. 2D and 2E) defined in other x-ray tube structures, such as the can 108.

Figure 3F:
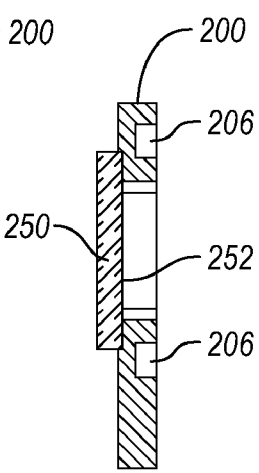
FIG. 3F is a cross-section side view of the example window and the example window frame of FIG. 3E.
Figure 3E:
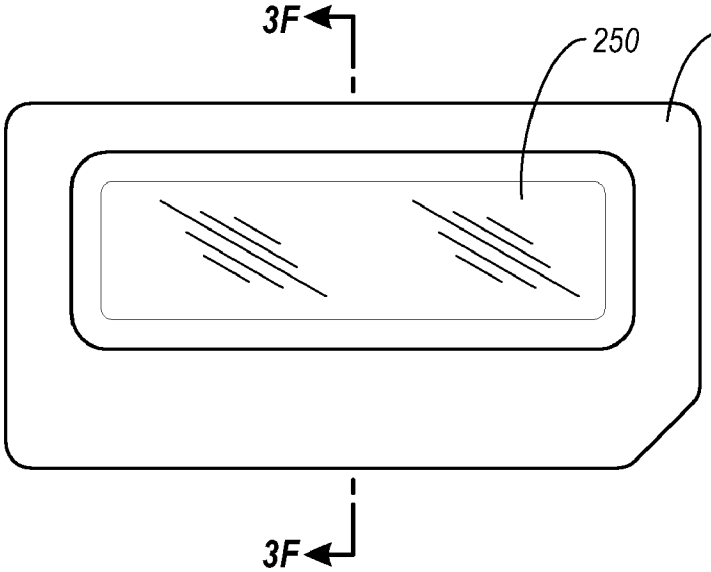
FIG. 3E is a top view of the example window of FIG. 3D mounted in the example window frame of FIG. 3A.
Figure 3D:
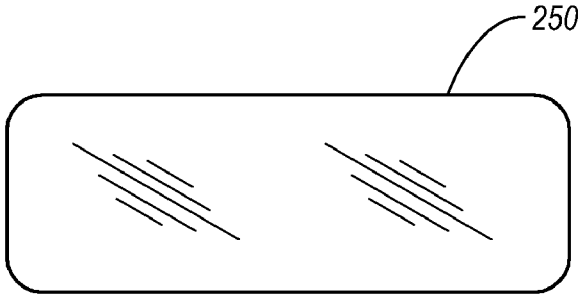
FIG. 3D is a top view of the example window of FIG. 2A.

FIG. 3D is a top view of the example window 250. The perimeter of the example window 250 is generally rectangularly shaped, although the perimeter could alternatively be various other shapes. In one example embodiment, the example window 250 is about 0.188 inches thick, although the example window 250 may alternatively be greater than or less than about 0.188 inches thick. The example window 250 can generally be formed from any x-ray transmissive material that is also capable of maintaining a vacuum in the vacuum enclosure of an x-ray tube, such as the vacuum enclosure 142 of the x-ray tube 102 disclosed herein. In one example embodiment, the window 250 may be formed from at least one of: beryllium, titanium, nickel, carbon, silicon, or aluminum.

FIGS. 3E and 3F disclose the example window 250 attached to the example window frame 200. As disclosed in FIG. 3E, the window 250 substantially covers the opening 202 (see FIG. 3A) defined by the window frame 200. A bottom side 252 (see FIG. 3F) the example window 250 can be bonded to the example window frame 200 in a variety of ways, including adhesion, brazing, and/or mechanical fastening.

In some example embodiments, the portion of the window frame 200 to which the window 250 is bonded may be recessed slightly (see, for example, recess 204 of FIG. 3A) such that the top of the window 250 extends only slightly above the top surface of the window frame 200. Alternatively, the window frame 200 may be recessed more extensively such that the top of the window 250 is flush with, or even recessed below, the top surface of the window frame 200.

As disclosed in FIGS. 2E and 2F, the second liquid passageway 150 is positioned, sized, and configured such that when the liquid coolant is present in the second liquid passageway 150, the liquid coolant makes direct contact with the window frame 200 and with the can 108. This direct contact of the liquid coolant with the window frame 200 and the can 108 can thus dissipate heat in the window frame 200 and the can 108 that is generated during x-ray tube operation. Also, by virtue of the fact that the example window 250 is bonded to the example window frame 200, when liquid coolant is present in the second liquid passageway 150, the example window 250 is in thermal communication with the liquid coolant. This thermal communication of the liquid coolant with the window 250 through the window frame 200 can thus dissipate heat in the window 250 generated during x-ray tube operation. The liquid coolant in the second liquid passageway 150 can thus have a cooling effect on, and thereby reduce thermally-induced deforming stresses on, the window frame 200, the can 108, the bond between the window frame 200 and the can 108, the window 250, and the bond between the window 250 and the window frame 200.

The example embodiments disclosed herein may be embodied in other specific forms. The example embodiments disclosed herein are therefore to be considered in all respects only as illustrative and not restrictive.

What is claimed is:

1. An x-ray tube comprising:

a housing defining an aperture through which electrons can pass from a cathode to an anode, the housing also defining an inlet port and an outlet port;

a window frame attached to the housing, the window frame defining an opening through which x-rays can pass; and a window attached to the window frame such that the window covers the opening defined by the window frame;

wherein the housing and the window frame are configured such that a first liquid coolant can flow from the inlet port to the outlet port through both:

a first liquid path at least partially defined by the housing; and a second liquid path cooperatively defined by the housing and the window frame, the second liquid path being disposed about at least a portion of the opening in the window frame such that any x-rays that pass through the opening do not also pass through the second liquid path.

2. The x-ray tube as recited in claim 1, wherein the window comprises at least one of: beryllium, titanium, nickel, carbon, silicon, or aluminum.

3. The x-ray tube as recited in claim 1, wherein the window further comprises a coating of electrically conductive material on a surface of the window facing the window frame, wherein the coating comprises at least one of: copper, stainless steel, or molybdenum.

4. The x-ray tube as recited in claim 1, wherein the window frame comprises copper.

5. An x-ray tube cooling system comprising:

a reservoir configured to hold a second liquid coolant, the reservoir defining a second inlet port and a second outlet port;

the x-ray tube as recited in claim 1 positioned substantially within the reservoir configured to be substantially surrounded by the second liquid coolant; and a first hose connecting the second inlet port to the inlet port; and a second hose connecting the second outlet port to the outlet port.

6. The x-ray tube cooling system as recited in claim 5, further comprising:

a cooling unit positioned external to the reservoir, the cooling unit defining a third inlet port and a third outlet port, the cooling unit configured to cool the first liquid coolant and circulate the first liquid coolant from the third inlet port to the third outlet port;

a third hose connecting the third outlet port to the second inlet port; and a fourth hose connecting the third inlet port to the second outlet port.

7. The x-ray tube cooling system as recited in claim 6, wherein the first liquid path and the second liquid path are sized and configured such that a pressure gradient exists when the first liquid coolant is flowing from the inlet port to the outlet port.

8. The x-ray tube as recited in claim 7, wherein the pressure gradient between the inlet port and the outlet port is about 6 psi.

9. The x-ray tube cooling system as recited in claim 6, wherein the first liquid path and the second liquid path are sized and configured such that about 4.2 gallons/minute of the first liquid coolant can flow between the inlet port and the outlet port.

10. The x-ray tube cooling system as recited in claim 6, wherein the first liquid path and the second liquid path are sized and configured such that, when the first liquid coolant is flowing between the inlet port and the outlet port, between about 90% and about 98% of the first liquid coolant flows through the first liquid path and between about 2% and about 10% of the first liquid coolant flows through the second liquid path.

11. The x-ray tube cooling system as recited in claim 6, wherein:

the first liquid coolant comprises a non-dielectric liquid; and the second liquid coolant comprising a dielectric liquid.

12. The x-ray tube cooling system as recited in claim 6, wherein:

the first liquid coolant comprising a dielectric liquid; and the second liquid coolant comprising a dielectric liquid.

13. The x-ray tube as recited in claim 1, wherein the window has a substantially uniform thickness.

14. The x-ray tube as recited in claim 1, wherein the window frame has a substantially uniform thickness.

15. The x-ray tube as recited in claim 1, wherein the second liquid path is disposed completely outside a periphery of the opening.

16. The x-ray tube as recited in claim 1, wherein the window frame is substantially non-transmissive to x-rays.

17. An x-ray tube comprising:

a housing defining an inlet port and an outlet port;

a window frame attached to the housing, the window frame defining an opening through which x-rays can pass;

a window attached to the window frame such that the window covers the opening defined by the window frame;

first, third, and fourth liquid passageways at least partially defined by the housing; and a second liquid passageway cooperatively defined by the housing and the window frame, the second liquid passageway being disposed about at least a portion of the opening in the window frame;

wherein a first portion of a first liquid coolant can flow from the inlet port to the outlet port through a first liquid path, defined by the first, second, and fourth liquid passageways, without flowing through the third liquid passageway; and wherein a second portion of the first liquid coolant can flow from the inlet port to the outlet port through a second liquid path, defined by the first, third, and fourth liquid passageways, without flowing through the second liquid passageway.

18. An x-ray tube cooling system comprising:

a reservoir configured to hold a second liquid coolant, the reservoir defining a second inlet port and a second outlet port;

the x-ray tube as recited in claim 17 positioned substantially within the reservoir configured to be substantially surrounded by the second liquid coolant;

a first hose connecting the second inlet port to the inlet port;

a second hose connecting the second outlet port to the outlet port;

a cooling unit positioned external to the reservoir, the cooling unit defining a third inlet port and a third outlet port, the cooling unit configured to cool the first liquid coolant and circulate the first liquid coolant from the third inlet port to the third outlet port;

a third hose connecting the third outlet port to the second inlet port; and a fourth hose connecting the third inlet port to the second outlet port.

19. The x-ray tube cooling system as recited in claim 18, wherein the first liquid path and the second liquid path are sized and configured such that a pressure gradient exists when the first liquid coolant is flowing from the inlet port to the outlet port.

20. The x-ray tube cooling system as recited in claim 18, wherein the first liquid path and the second liquid path are sized and configured such that, when the first liquid coolant is flowing between the inlet port and the outlet port, between about 93% and about 98% of the first liquid coolant flows through the first liquid path and between about 2% and about 7% of the first liquid coolant flows through the second liquid path.

21. The x-ray tube as recited in claim 17, wherein the second liquid passageway is disposed about a periphery of at least a portion of the opening such that any x-rays that pass through the opening do not also pass through the second liquid passageway.

22. An x-ray tube comprising:

a can;

a liquid manifold attached to the can, the liquid manifold defining an inlet port and an outlet port, a shield structure attached to the can, the shield structure defining an aperture that allows electrons to pass from an electron source to a target anode;

a window frame attached to the can, the window frame defining an opening through which x-rays can pass;

a window attached to the window frame such that the window covers the opening defined by the window frame;

a first liquid passageway cooperatively defined by the liquid manifold, the can, and the shield structure;

a second liquid passageway cooperatively defined by the can and the window frame, the second liquid passageway being disposed about at least a portion of the opening in the window frame;

a third liquid passageway cooperatively defined by the can and the shield structure;

a fourth liquid passageway cooperatively defined by the can, the shield structure, and the liquid manifold; and wherein a first portion of a first liquid coolant can flow from the inlet port to the outlet port through a first liquid path, defined by the first, second, and fourth liquid passageways, without flowing through the third liquid passageway; and wherein a second portion of the first liquid coolant can flow from the inlet port to the outlet port through a second liquid path, defined by the first, third, and fourth liquid passageways, without flowing through the second liquid passageway.

23. An x-ray tube cooling system comprising:

a reservoir configured to hold a second liquid coolant, the reservoir defining a second inlet port and a second outlet port;

the x-ray tube as recited in claim 22 positioned substantially within the reservoir configured to be substantially surrounded by the second liquid coolant;

a first hose connecting the second inlet port to the inlet port;

a second hose connecting the second outlet port to the outlet port;

a cooling unit positioned external to the reservoir, the cooling unit defining a third inlet port and a third outlet port, the cooling unit configured to cool the first liquid coolant and circulate the first liquid coolant from the third inlet port to the third outlet port;

a third hose connecting the third outlet port to the second inlet port; and a fourth hose connecting the third inlet port to the second outlet port.

24. The x-ray tube cooling system as recited in claim 23, wherein the first liquid path and the second liquid path are sized and configured such that a pressure gradient exists when the first liquid coolant is flowing from the inlet port to the outlet port.

25. The x-ray tube cooling system as recited in claim 23, wherein the first liquid path and the second liquid path are sized and configured such that, when the first liquid coolant is flowing between the inlet port and the outlet port, between about 94% and about 97% of the first liquid coolant flows through the first liquid path and between about 3% and about 6% of the first liquid coolant flows through the second liquid path.

26. The x-ray tube as recited in claim 22, wherein the second liquid passageway is disposed completely outside a periphery of the opening.

* * * * *

UNITED STATES PATENT AND TRADEMARK OFFICE

CERTIFICATE OF CORRECTION

PATENT NO. : 7,688,949 B2
APPLICATION NO. : 12/028698
DATED : March 30, 2010
INVENTOR(S) : Don Lee Warburton et al.

It is certified that error appears in the above-identified patent and that said Letters Patent is hereby corrected as shown below:

Column 7, lines 9-22 – change each "first liquid path 160" to --second liquid path 162--

Column 7, lines 9-22 – change each "second liquid path 162" to --first liquid path 160--

Column 9, line 30 – change "first liquid path" to --second liquid path--

Column 9, lines 32-37 – change each "second liquid path" to --first liquid path--

Column 10, line 21 – change "first liquid path" to --second liquid path--

Column 10, line 22 – change "second liquid path" to --first liquid path--

Column 11, line 32 – change "first liquid path" to --second liquid path--

Column 11, line 33 – change "second liquid path" to --first liquid path--

Column 12, line 48 – change "first liquid path" to --second liquid path--

Column 12, line 49 – change "second liquid path" to --first liquid path--

Signed and Sealed this
Nineteenth Day of March, 2013

Teresa Stanek Rea
*Acting Director of the United States Patent and Trademark Office*